US011659866B2

(12) United States Patent
Liu

(10) Patent No.: US 11,659,866 B2
(45) Date of Patent: May 30, 2023

(54) ATOMIZATION ASSEMBLY AND HOOKAH COMPRISING THE SAME

(71) Applicant: Tuanfang Liu, Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 313 days.

(21) Appl. No.: 17/026,341

(22) Filed: Sep. 21, 2020

(65) Prior Publication Data

US 2021/0177060 A1 Jun. 17, 2021

(30) Foreign Application Priority Data

Dec. 12, 2019 (CN) ..... 201911273596.1
Dec. 12, 2019 (CN) ..... 201922243793.0

(51) Int. Cl.
*A24F 13/00* (2006.01)
*A24F 40/465* (2020.01)
*A24F 40/50* (2020.01)
*A24F 1/30* (2006.01)

(52) U.S. Cl.
CPC ..... *A24F 40/465* (2020.01); *A24F 1/30* (2013.01); *A24F 40/50* (2020.01)

(58) Field of Classification Search
CPC ..... A24F 47/00
USPC ..... 131/328–329
See application file for complete search history.

(56) References Cited

U.S. PATENT DOCUMENTS

2017/0055583 A1* 3/2017 Blandino ..... H05B 6/108

* cited by examiner

*Primary Examiner* — Phuong K Dinh
(74) *Attorney, Agent, or Firm* — Matthias Scholl P.C.; Matthias Scholl

(57) ABSTRACT

An atomization assembly including a metal cylinder and a magnetic induction coil. The magnetic induction coil is disposed around the metal cylinder. When the metal cylinder is in an electrified state, a heat is produced to heat a smoke material therein to produce smoke.

3 Claims, 4 Drawing Sheets

ATOMIZATION ASSEMBLY AND HOOKAH COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 201911273596.1 filed Dec. 12, 2019, and to Chinese Patent Application No. 201922243793.0 filed Dec. 12, 2019. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to an atomization assembly and a hookah comprising the same.

Conventional hookahs are driven by a built-in battery to produce an open fire heat the smoke materials placed in the atomization assembly.

SUMMARY

The disclosure provides an atomization assembly, comprising a metal cylinder and a magnetic induction coil; wherein the magnetic induction coil is disposed around the metal cylinder; when the metal cylinder is in an electrified state, a heat is produced to heat a smoke material therein to produce smoke.

The atomization assembly further comprises an isolation cylinder disposed between the magnetic induction coil and the metal cylinder.

The atomization assembly further comprises a fixing part and a silicone sleeve; the silicone sleeve is disposed around the magnetic induction coil; and the silicone sleeve and the magnetic induction coil are fixed in the fixing part.

The atomization assembly further comprises a first silicone seal, a control panel, a conduit, a second silicone seal, and a third silicone seal; the first silicone seal is disposed on a top end of the conduit; the conduit is in threaded connection to the fixing part to support the metal cylinder; the control panel comprises an output end soldered on the magnetic induction coil; and the second silicone seal and the third silicone seal are disposed around a bottom end of the conduit in order.

The disclosure also provides a hookah, comprising the atomization assembly and a water filter configured to filter the smoke produced by the atomization assembly.

The water filter comprises a water container, a first air channel and a second air channel; the first air channel comprises a first end connected to the atomization assembly and a second end submerged below a liquid graduation line of the water container; the second air channel comprises a third end connected to a smoke exit and a fourth end disposed above the liquid graduation line; when in use, the water container is filled with water; the smoke produced by the atomization assembly enters the water from the first end, is filtered by the water, escapes from the water, and flows to the smoke exit.

The hookah is portable, easy to carry, comprises no battery and is driven by an external power supply.

DETAILED DESCRIPTION

To further illustrate, embodiments detailing an atomization assembly and a hookah comprising the same are described below. It should be noted that the following embodiments are intended to describe and not to limit the disclosure.

Definitions

Principle of high frequency heating: an alternating magnetic field is generated when an alternating current is passing through a magnetic induction coil. And an eddy current is produced when a metal conductor is placed in the alternating magnetic field, and the eddy current will make the metal conductor heat up.

Smoke materials refer to smoke oil, tobacco, tobacco and other materials used to produce smoke.

Hookah: long pipe for smoking that allows smoke to pass through a water container to cool it.

Figure 1:
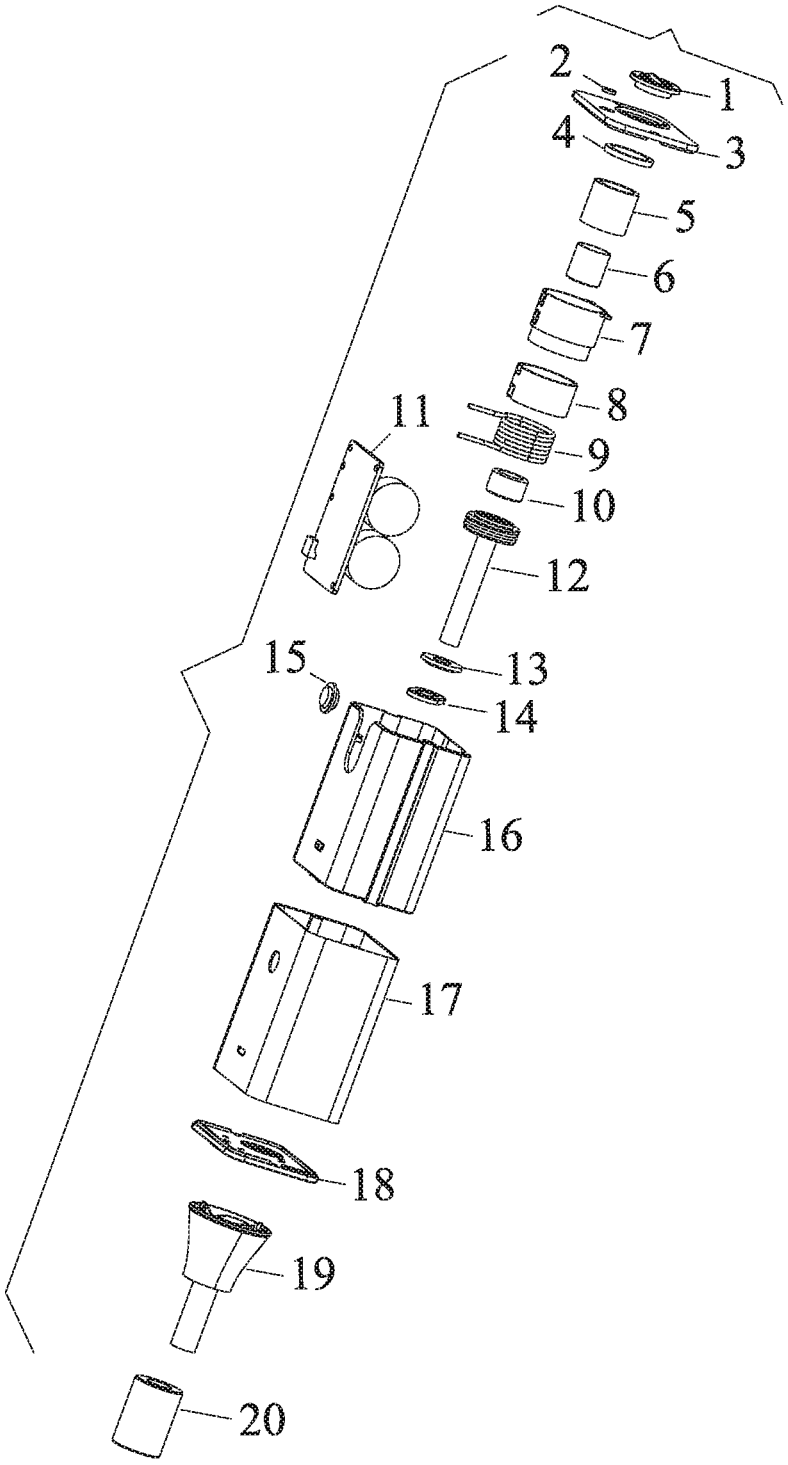
FIG. 1 is an exploded view of an atomization assembly according to one embodiment of the disclosure.
Figure 2:
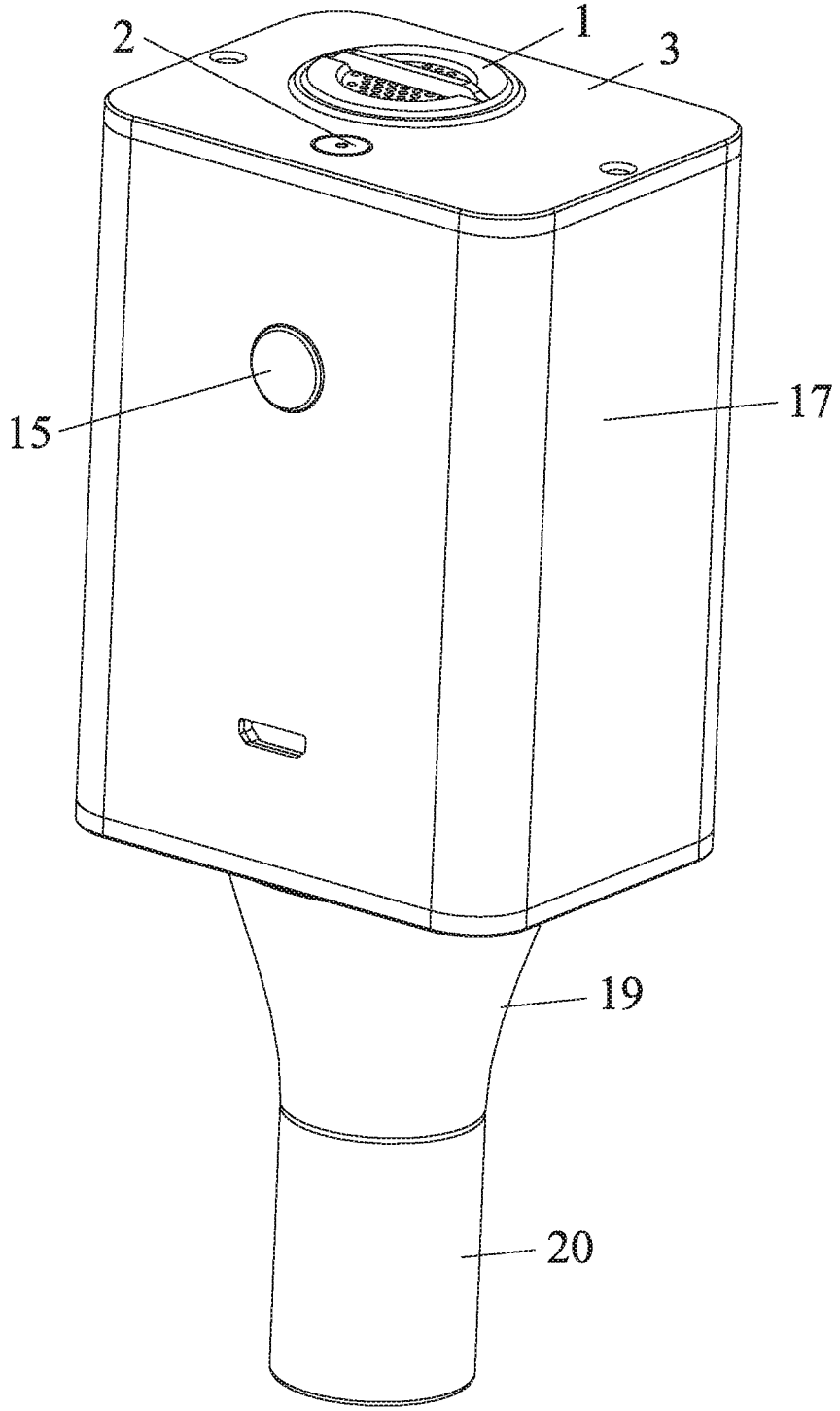
FIG. 2 is a schematic diagram of an atomization assembly according to one embodiment of the disclosure.
Figure 3:
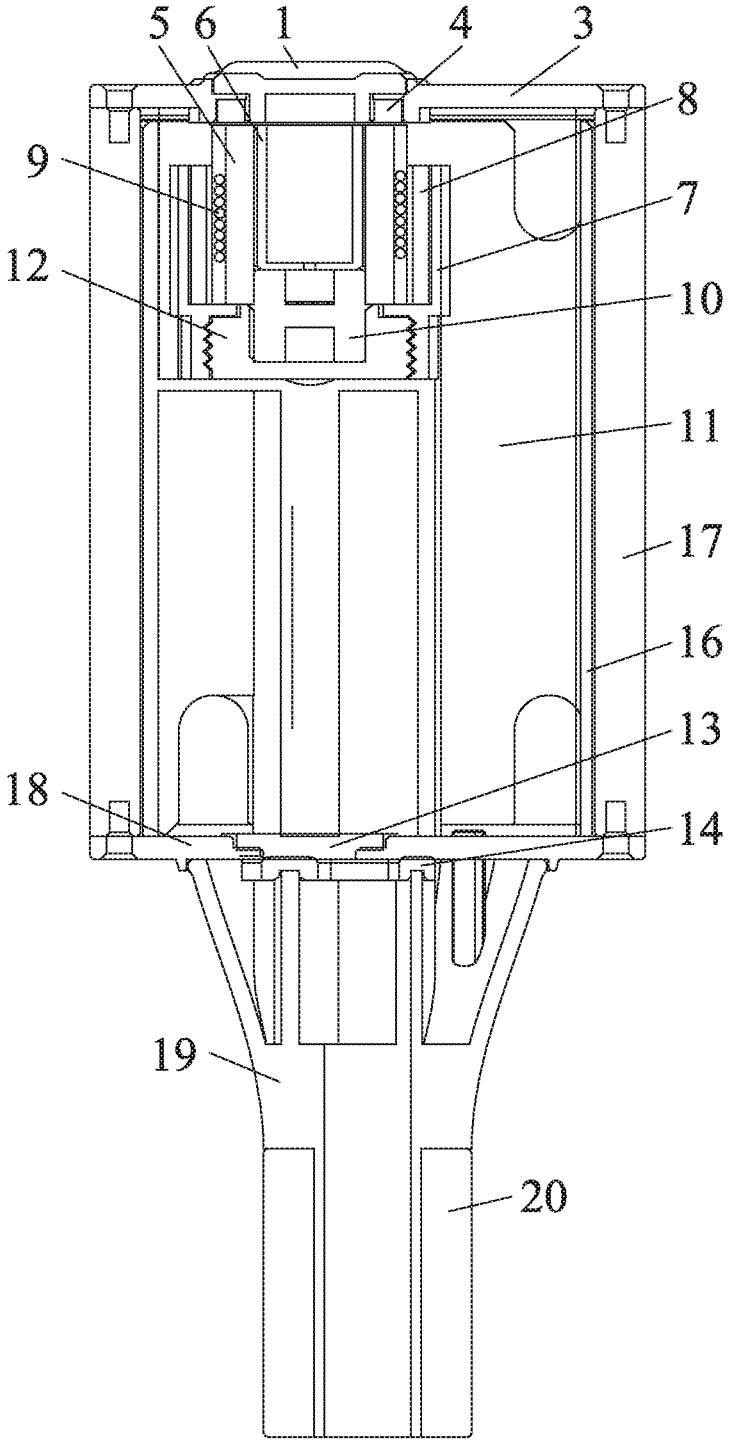
FIG. 3 is a sectional view of an atomization assembly according to one embodiment of the disclosure.
Figure 4:
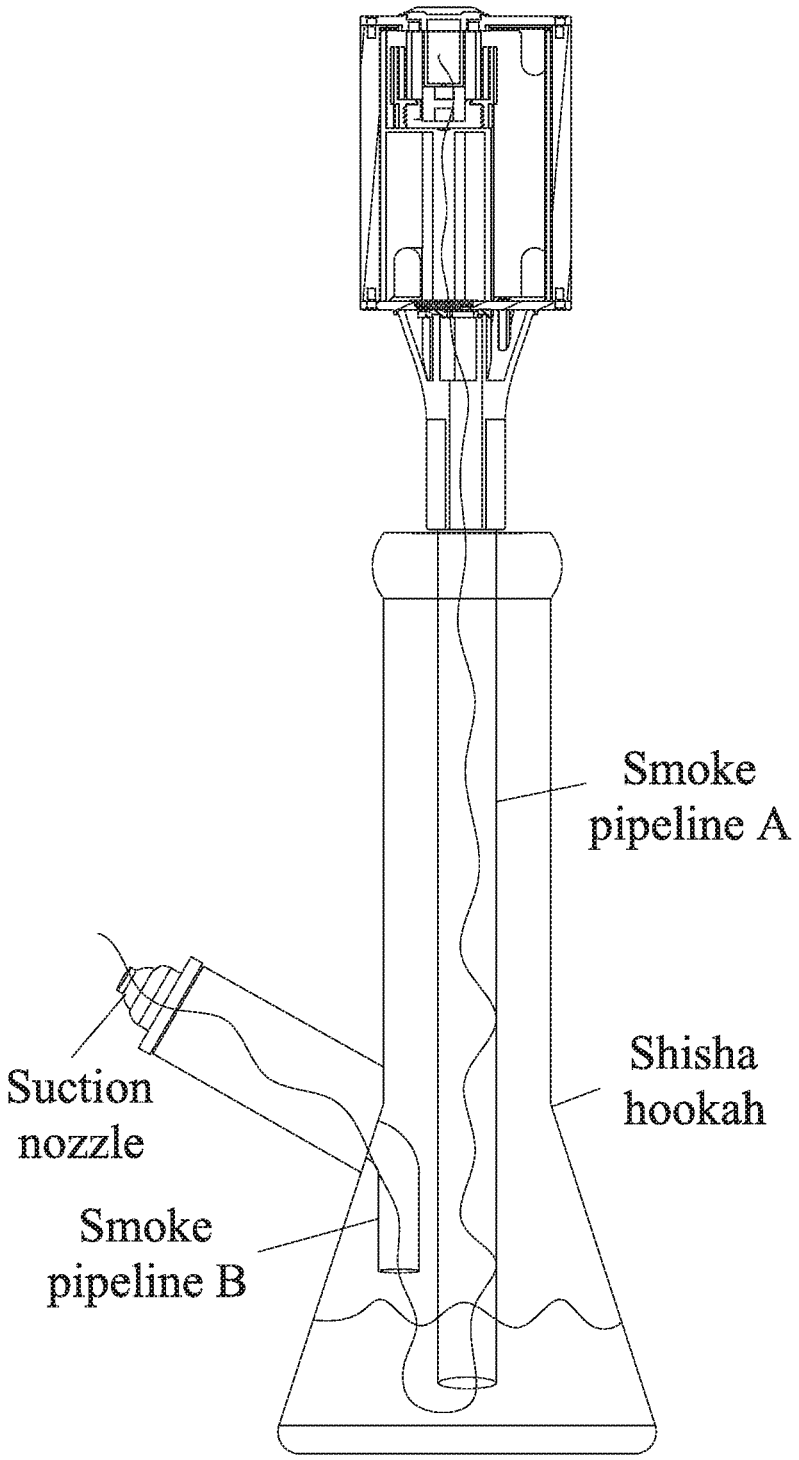
FIG. 4 is a schematic diagram of a hookah according to one embodiment of the disclosure.

As shown in FIGS. 1-4, an atomization assembly comprises a metal cylinder 6 and a magnetic induction coil 9; wherein the magnetic induction coil 9 is disposed around the metal cylinder 6; when the metal cylinder is in an electrified state, a heat is produced to heat a smoke material therein to produce smoke.

Specifically, in certain embodiments, the atomization assembly comprises a top cover 1, a mirror 2, an upper cover 3, a magnet 4, an isolation cylinder 5, a metal cylinder 6, a fixing part 7, a silicone sleeve 8, a magnetic induction coil 9, a first silicone seal 10, a control panel 11, a conduit 12, a second silicone seal 13, a third silicone seal 14, a button 15, a support 16, a housing 17, a base 18, a mouthpiece 19, and a sleeve 20. The silicone sleeve 8 is disposed around the magnetic induction coil 9 to prevent the abrasion of the magnetic induction coil. The silicone sleeve 8 and the magnetic induction coil 9 are fixed in the fixing part 7. The isolation cylinder 5 is disposed in the magnetic induction coil 9 to isolate the magnetic induction coil 9. The metal cylinder 6 is disposed in the isolation cylinder 5 and functions as a conductor to heat the smoke materials. The first silicone seal 10 is disposed on the top end of the conduit 12; the conduit 12 is in threaded connection to the fixing part 7 to support the metal cylinder 6; the control panel 11 comprises an output end soldered on the magnetic induction coil 9; and the second silicone seal 13 and the third silicone seal 14 are disposed around the bottom end of the conduit 12 in order. The conduit 12 is disposed in the support 16. The button 15 is dispose don the support 16. The support 16 is disposed in the housing 17. The mirror 2 is disposed on the upper cover 3. The upper cover 3 is disposed on the top end of the support 16. The magnet 4 is disposed on the top cover 1. The top cover 1 is disposed on the upper cover 3 to seal the metal cylinder 6. The base 18 is disposed on the bottom end of the housing 17. The sleeve 20 is disposed around the mouthpiece 19 and the mouthpiece 19 is disposed on the base 18. The conduit 12 comprises a bottom opening communicating with the mouthpiece 19. The hookah operates to heat the smoke materials based on the electromagnetic induction heating principle. The atomization assembly comprises no battery and is driven by an external power supply. The button 15 is connected to the external power supply. Pressing the button, and the external power supply supplies power for the atomization assembly. In certain embodiments, the atomization assembly is combined with a water container for use.

Also provided is a hookah, comprising the atomization assembly and a water filter configured to filter the smoke produced by the atomization assembly.

The water filter comprises a water container, a first air channel A and a second air channel B; the first air channel A comprises a first end connected to the atomization assembly and a second end submerged below a liquid graduation line of the water container; the second air channel B comprises a third end connected to a smoke exit and a fourth end disposed above the liquid graduation line; when in use, the water container is filled with water; the smoke produced by the atomization assembly enters the water from the first end, is filtered by the water, escapes from the water, and flows to the smoke exit.

The hookah is portable and easy to carry.

In certain embodiments, the isolation cylinder can be made of ceramic, glass, quartz, agate, mica and jade. It has good thermal insulation and plays an important role in heat insulation protection of the magnetic induction coil.

The metal cylinder is a container with various shapes. Optionally, all or part of the metal cylinder is metal materials.

It will be obvious to those skilled in the art that changes and modifications may be made, and therefore, the aim in the appended claims is to cover all such changes and modifications.

What is claimed is:

1. An atomization assembly, comprising: a metal cylinder, a magnetic induction coil, an isolation cylinder, a fixing part, a silicone sleeve, a first silicone seal, a control panel, a conduit, a second silicone seal, and a third silicone seal; wherein:

the magnetic induction coil is disposed around the metal cylinder;

when the metal cylinder is in an electrified state, a heat is produced to heat a smoke material therein to produce smoke;

the isolation cylinder is disposed between the magnetic induction coil and the metal cylinder;

the silicone sleeve is disposed around the magnetic induction coil;

the silicone sleeve and the magnetic induction coil are fixed in the fixing part;

the first silicone seal is disposed on a top end of the conduit;

the conduit is in threaded connection to the fixing part to support the metal cylinder;

the control panel comprises an output end soldered on the magnetic induction coil; and the second silicone seal and the third silicone seal are disposed around a bottom end of the conduit in order.

2. A hookah, comprising the atomization assembly of claim 1, and a water filter configured to filter the smoke produced by the atomization assembly.

3. A hookah, comprising an atomization assembly, and a water filter configured to filter the smoke produced by the atomization assembly; wherein:

the atomization assembly comprises a metal cylinder, and a magnetic induction coil;

the magnetic induction coil is disposed around the metal cylinder, when the metal cylinder is in an electrified state, a heat is produced to heat a smoke material therein to produce smoke;

the water filter comprises a water container, a first air channel and a second air channel;

the first air channel comprises a first end connected to the atomization assembly and a second end submerged below a liquid graduation line of the water container;

the second air channel comprises a third end connected to a smoke exit and a fourth end disposed above the liquid graduation line;

when in use, the water container is filled with water; the smoke produced by the atomization assembly enters the water from the first end, is filtered by the water, escapes from the water, and flows to the smoke exit.

* * * * *